United States Patent [19]

Fournier et al.

[11] Patent Number: 4,496,919

[45] Date of Patent: Jan. 29, 1985

[54] RELAY FOR ULTRA HIGH FREQUENCY COAXIAL SWITCHING

[75] Inventors: Andre Fournier, La Verpillere; Gilles Billet, Voiron, both of France

[73] Assignee: Micronde, Saint Quentin Fallavier, France

[21] Appl. No.: 469,261

[22] Filed: Feb. 24, 1983

[30] Foreign Application Priority Data

Feb. 24, 1982 [FR] France ..... 82 03049

[51] Int. Cl.[3] ..... H01H 53/00

[52] U.S. Cl. ..... 335/5; 335/128; 333/105

[58] Field of Search ..... 335/5, 4, 21, 22, 24, 335/25, 26, 27, 28; 333/101, 105

[56] References Cited

U.S. PATENT DOCUMENTS 2,498,907 2/1950 Atwood et al. ..... 335/5

4,298,847 11/1981 Hoffman ..... 335/5

FOREIGN PATENT DOCUMENTS 1174469 3/1959 France ..... 333/101

*Primary Examiner*—E. A. Goldberg

*Assistant Examiner*—George Andrews

*Attorney, Agent, or Firm*—Brisebois & Kruger

[57] ABSTRACT

A relay for switching of ultra high frequency circuits has three spaced-apart coaxial type contacts including a central or common contact. Two contact blades are disposed in opposed relation to the coaxial contact for alternate movement from a first position in which one rigid contact engages the central coaxial contact and one side contact while the other rigid contact is grounded, and a second position in which the other rigid contact engages the central contact and another coaxial contact and the first rigid contact is grounded. Pusher elements connected to the respective rigid contacts are connected to opposite sides of a leaf spring supported at its center. A pivotal armature alternately presses on one end or the other of a leaf spring to drive one rigid contact against its two coaxial contacts and to permit the other end of the leaf spring to pull the other rigid contact into engagement with the ground plane.

10 Claims, 9 Drawing Figures

RELAY FOR ULTRA HIGH FREQUENCY COAXIAL SWITCHING

BACKGROUND OF THE INVENTION

This invention relates to relays for switching of ultra high frequency coaxial circuits, and is of the type comprising three fixed coaxial switching contacts including a centrally located contact, and two rigid blade contacts arranged to alternately engage the central contact and one of the other two coaxial contacts. The arrangement is such that when one of the rigid blade contacts is in a circuit closing position, the other contact engages a ground plane. The contact blades are fixed respectively to isolating pushers or drivers and each of the pushers is driven in a straight line by a leaf spring, in turn driven by a magnetic armature, having two arms and pivotal about a central axis, under the action of an electromagnetic motor. The relay can be of the change-over switch type.

The electromagnetic motor can, for example, be of the monostable type, advantageously having a winding whose magnetic core has its axis intersecting the pivotal axis of the armature, and a first pole in the form of a bar of magnetic material having a pole end facing one of the arms of the armature and its other end connected by a magnetic material connecting plate to the core. Advantageously, the magnetic circuit includes a permanent magnet between the other pole element and the magnetic connecting plate. The other pole element is in opposed relation to the other arm of the armature. The magnetic connecting plate provides for the passage of magnetic flux from the permanent magnet through the core of the winding and the bar forming the first pole piece and which is opposed to the first arm of the armature. The flux created by the permanent magnet in the core of the winding is of opposite polarity to the flux created in the core when the winding is energized.

To assure proper operation of such switching relays, it is necessary to obtain the highest quality of transmission possible between the lines of the switched coaxial line, and very high isolation between the lines of the non-switched coaxial line.

For this result one has previously used return springs which oppose the force with which the pushers are driven by the armature, and which press the blades of the contacts connected to the pushers against the ground plane.

Relays for ultra high frequency coaxial switching, of the type mentioned, have the disadvantage that high energy is required to assure sufficient force to press the contact for the switched line into good engagement with the coaxial contacts of the switched line, to obtain good transmission, and to also obtain sufficient force to press the contact associated with the unswitched line against the ground plane to assure good isolation. The bearing pressure with the ground contact plane depends upon the return force of the springs which support the pushers, and this return force is opposed to and must be overcome by the pusher when it is driven by the action of the relay motor.

SUMMARY OF THE INVENTION

The present invention relates to an embodiment of relay for ultra high frequency coaxial switching of simple mechanical construction, avoiding the use of return springs and requiring only low energy consumption to assure switching from one switching position to the other.

The relays according to the invention are characterized by the fact that a leaf or blade spring is fixed at its center to a projection aligned with the axis of the central coaxial contact, the leaf spring having on opposite sides of its central part, means for fixing the pushers to the spring, and the armature comprises the means, during its pivoting for exerting a force on the leaf spring in the vicinity of the extremities of the spring.

In a preferred embodiment, the armature comprises at its extremities, projections in the form of rods each having means thereon to engage the leaf spring, for example, a glass bead.

In the preferred embodiment, each of the pushers has, for fixing to the leaf spring, a retaining groove, the leaf spring having a bayonet slot opening to receive and fix each of the pushers. This bayonet slot opening takes the form of an opening of a diameter corresponding to that of the pusher and a longitudinal slot extending from the opening. Advantageously, the groove in each pusher extends longitudinally, in the retaining position on the leaf spring, and has a central part of narrow dimension which enlarges in a direction toward its sides, thus permitting a certain elastic play or movement of the leaf spring with respect to the pushers, when the armature bears on the leaf spring.

In a preferred embodiment, the leaf spring has a central opening for engagement on a projection of an insulated support or plate, preferably molded of plastic material as a single piece and positioned on the ground plane. This support or plate has openings for receiving the pushers, and means to support the pivotal axis of the armature. This plate also has the openings necessary for receiving screws for assembling the relay.

Advantageously, the support plate also has on the face opposite that with the support projection, insulating pins, preferably molded with the plate as a single piece, which traverse the ground plane and serve to vertically guide the rigid contact blades which are advantageously each fixed to an end of the pusher opposite the end of the pusher which is fixed to the leaf spring.

Advantageously, in accordance with the invention, the ground plane, separate from the insulating plate or support, can be easily formed by cutting a thin metal plate.

Other advantages and characteristics of the invention will become apparent from reading of the following description of an exemplary embodiment given as a non-limiting example with reference to the drawings.

DETAILED DESCRIPTION

Figure 1:
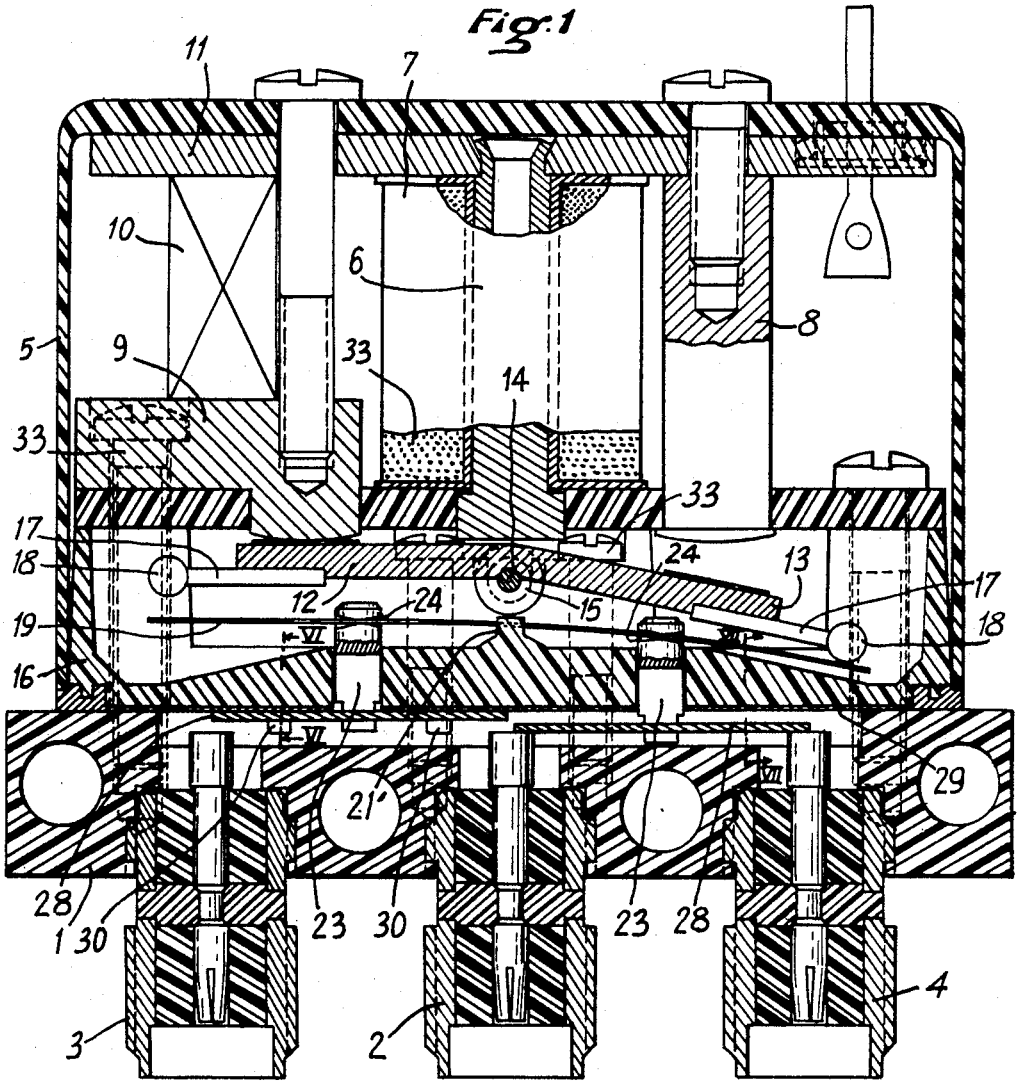
FIG. 1 is a front view in vertical section of a relay for ultra high frequency coaxial switching, according to the invention, and which uses a monostable electromagnetic motor.

The coaxial circuit switching relay according to the invention has, in a conventional manner, a base 1 in the form of a block, on which are mounted three coaxial contacts, namely, a central common contact 2, and two side contacts 3 and 4. As is evident from FIG. 1, each of the contacts 2–4 takes the form of a coaxial contact appropriately mounted on base 1.

Within a casing or cover 5 is an electromagnetic motor composed of a cylindrical core 6 with a coil or winding 7 on the core. Core 6 is formed from pure iron or other non-retentive magnetic material, and coil 7 is in use of the relay connected to a source of electrical current and creates magnetic flux in the core 6 when the coil is energized.

The magnetic circuit of the relay also comprises a bar 8 of pure iron or of other non-retentive magnetic material and a pole piece 9 also of pure iron or other non-retentive magnetic material. Mounted on pole piece 9 is a permanent magnet 10, and a connecting plate 11 clamps the permanent magnet between the plate and pole piece 9 as shown at FIG. 1. Connecting plate 11 is also formed from pure iron or other non-retentive magnetic material, and is magnetically connected to bar 8, core 6, and permanent magnet 10.

The permanent magnet is so oriented that the magnetic flux from permanent magnet 10 flows through core 6 in a direction opposite to the magnetic flux created in the core when winding 7 is energized.

Since the structure and function of such an electromagnet is relatively well known, it will not be described herein in great detail.

The relay according to this invention comprises an assembly movable under the action of the electromagnetic motor. This movable assembly comprises an armature of non-retentive magnetic material, preferably pure iron, having two legs 12 and 13 and a central axle 14 directly below and intersecting the axis of the core 6. Legs 12 and 13 are each flat plate portions of the armature, and form an angle of approximately 170° with each other, it being recognized that this angle can be smaller or greater depending on the required extent of movement of the armature.

Figure 8:
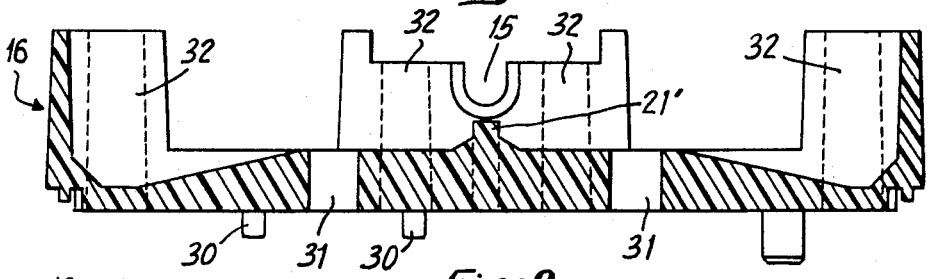
FIG. 8 is a view in section of a support stand or plate of the relay according to the invention, as seen when looking along line VIII—VIII of FIG. 9.
Figure 9:
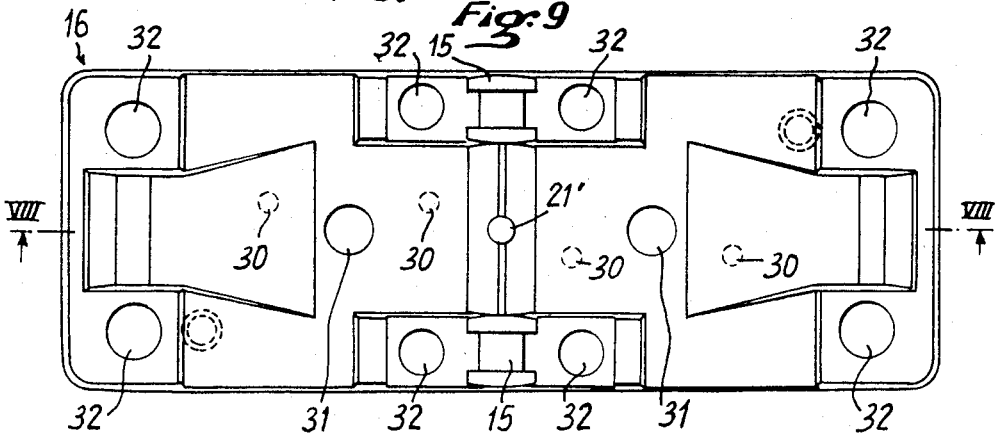
FIG. 9 is a top plan view of the support plate of FIG. 8.

The pivot pin or axle 14 is journalled in bearings 15 at opposite sides of a support block or plate 16. This support plate which is best seen at FIGS. 8 and 9 is preferably formed as a single piece of molded plastic material and will later be described in greater detail.

Fixed to the ends of arms 12 and 13 of the armature are outwardly extending rods 17. Fixed to the outer end of each rod 17 is a bead or ball 18 of glass or similar material.

Figure 2:
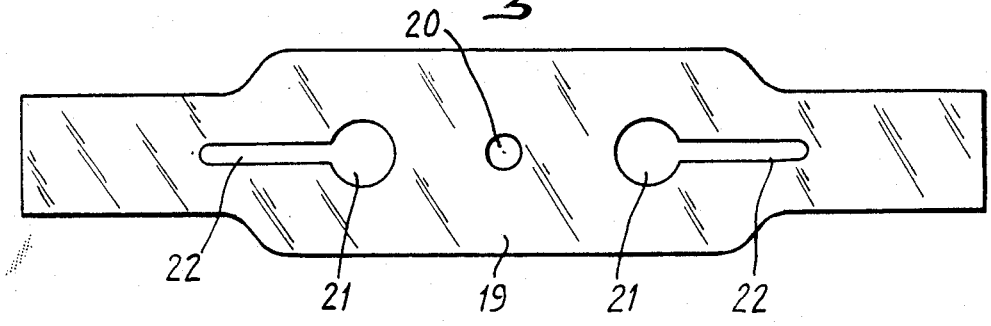
FIG. 2 is a top plan view of a leaf spring driver of the relay of FIG. 1.

The relay of the invention also comprises a one-piece leaf or blade spring 19 which is shown at FIGS. 1 and 2. This leaf spring has a central opening 20 by which it is mounted on a projection 21′ of corresponding form of support plate 16.

The leaf spring 19 has a bayonet slot type opening spaced from each side of the central opening 20. This bayonet slot in each instance takes the form of a circular opening 21 from which a longitudinal slot 22 extends. Slots 22 and openings 20 and 21 are each centered on a central longitudinal axis of leaf spring 19. The opening 21 and slot 22 at each side of leaf spring 19 comprise means for securing a pusher or driver 23 to the spring in a manner which will now be described.

Figure 3:
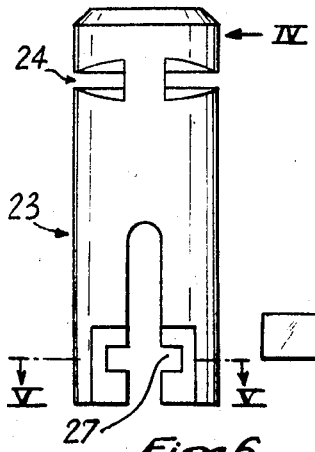
FIG. 3 is a side view in elevation of a pusher element of the relay according to the invention.
Figure 5:
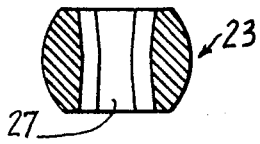
FIG. 5 is a view in section taken along line V—V of FIG. 3.
Figure 4:
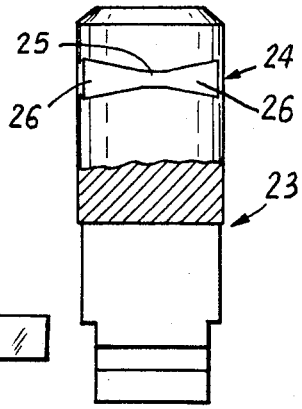
FIG. 4 is a front view in elevation, partially in section, of the pusher of FIG. 3, looking along the arrow IV of FIG. 3.
Figure 10:
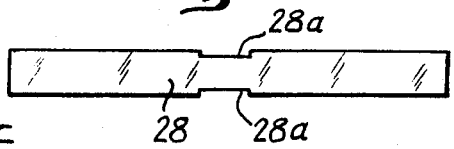
FIG. 10 is a top plan view of a rigid plate or blade contact used in the relay of FIG. 1.

The insulating pusher or driver 23 is best shown at FIGS. 3–5. For mounting pusher 23 on leaf spring 19, each pusher 23 has near its upper end, outwardly opening grooves 24, the material of pusher 23 remaining between the grooves being of a width essentially equal to the width of slot 22, of spring 19.

As shown at FIG. 4, each groove 24 has a narrow central region 25, and each groove widens or diverges toward the ends 26.

To mount a pusher 23 on leaf spring 19, the pusher 23 is inserted into opening 21, to the level of the grooves 24, and the grooves are then aligned with the sides of slot 22 and the pusher is then moved outwardly into the slot. The narrow portion 25 of each groove has a dimension essentially corresponding to the thickness of leaf spring 19, whereas the diverging ends 26 of each groove provide clearance to permit some angular movement of the leaf spring in the grooves 24, as is believed evident from FIG. 1. The lower portion of each pusher 23 comprises generally rectangular grooves or recesses 27 which open toward each other. These recesses 27 are dimensioned to engage and retain a rigid blade contact 28 having notches 28*a* on opposite sides which fit in the recesses. There are two rigid blade contacts 28: one for engagement with the coaxial contacts 2 and 4, and the other for engagement with the coaxial contacts 2 and 3.

As shown at FIG. 1, when the righthand contact 28 engages and connects the coaxial contacts 2 and 4, the lefthand contact 28 engages a ground plane in the form of a stamped metal plate 29 at the bottom of support plate 16, and between plate 16 and the base 1.

Figure 6:
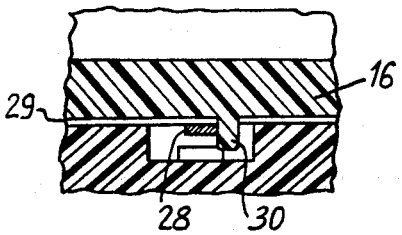
FIG. 6 is a view in section taken along line VI—VI of FIG. 1.
Figure 7:
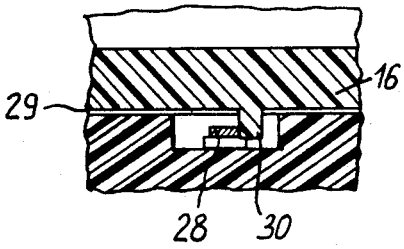
FIG. 7 is a view in section taken along line VII—VII of FIG. 1.

The support plate 16, best shown at FIGS. 8 and 9 further comprises insulating pins or projections 30 projecting toward base 1, for vertically guiding the rigid contact blades 28 in the manner shown at FIGS. 6 and 7. As shown at FIG. 6, for the lefthand contact 28 of FIG. 1, the guide pins 30 are closely adjacent to one side edge of the contact when this contact 28 is in its retracted position in engagement with the ground plate 29. Similarly, as shown at FIG. 7, the guide pins 30 for the righthand contact 28 of FIG. 1 are adjacent a common edge of this contact 28. In both instances, the guide pins 30 have a length to guide the rigid blade contact along its entire stroke of movement between the ground plane 29 and a position of engagement with the contacts 2, 3 or 2, 4. These guide pins are preferably molded as a single piece with the support plate 16.

Support plate 16 also has openings 31 to slideably receive pushers 23, and openings 32 to receive screws for assembly of the relay. The plate 29 constituting the ground plane has corresponding openings for the pushers and assembly screws, and also has openings to accomodate the guide pins 30.

When it is desired to create the switching connection between the coaxial contacts 2 and 4, the armature is caused to pivot to the position shown at FIG. 1 in which the arm 12 of the armature is pulled into engagement with pole piece 9.

In the course of such movement, the bead 18 located at the end of arm 13 of the armature applies pressure to the righthand end of spring 19, as viewed at FIG. 1 to pivot the righthand end of spring 19 downwardly and thus drive the insulating pusher 23 downwardly to cause contact 28 to engage coaxial contacts 2 and 4. When the righthand contact blade 28 moves downwardly toward the coaxial contacts 2 and 4, the lefthand contact blade 28 is driven upwardly into engagement with the ground plane plate 29. The additional movement of the armature before its arm 12 abuts pole element 9 has the effect of bending the leaf spring 19 to create the necessary contact pressure for the righthand rigid contact blade against the coaxial contacts 2 and 4, and such bending increases the pressure of the lefthand contact 28 with the ground plane plate 29.

Needed contact pressures and compensation for mechanical tolerances of the mounting can be attained by bending the rods 17 which support the glass beads 18.

The mechanical dimensions are determined for that relay entry toward the non-switched line, the contact 3 when the relay is in the position of FIG. 1, and one obtains a wave guide effect for utilization frequencies of switching relays, to below the cut-off frequency.

It is believed evident that FIG. 1 shows the position of the relay and its contacts when coil 7 is unenergized. In such an unenergized condition, permanent magnet 10 has a flux path through plate 11, core 6, the armature, and pole piece 9. When winding 7 is energized, magnetic flux is created which opposes the magnetic flux of the permanent magnet 10 thereby causing the armature to switch positions so that its arm 13 is pulled against the pole face of bar 8. In such a position (not shown) contacts 2 and 3 are connected by the rigid contact plate 28 at the lefthand side of FIG. 1, and the plate 28 at the righthand side of FIG. 1 is pulled upwardly by spring 19 into engagement with the ground plane plate 29.

It is to be appreciated that different magnetic circuit arrangements and different electromagnet arrangements can be used in lieu of the magnetic arrangements described herein. For example, the relay magnetic circuit could be of the bi-stable type rather than the monostable type described with reference to the preferred embodiment.

While the invention has been described in connection with a particular preferred embodiment, it is to be understood that the description is not limiting, and that numerous changes and modifications can be made without departing from the scope and spirit of the invention.

We claim:

1. A relay for switching high frequency lines comprising, a support, a plurality of spaced apart coaxial contacts on said support, said coaxial contacts comprising a first coaxial contact between a second coaxial contact and a third coaxial contact, first and second rigid blade contacts, a ground plane spaced from said coaxial contacts, a force transmitting insulating pusher fixed to each rigid blade contact, and means for alternately moving said blade contacts from a one position in which said first blade contact engages said first and second coaxial contacts and said second blade contact engages said ground plane, to another position in which said second blade contact engages said first and third coaxial contacts and said first blade contact engages said ground plane, said means comprising a leaf spring connected at its center to a central support, means for connecting said pusher element for said first blade contact to said spring on one side of said central support, means for connecting the pusher for said second blade contact to said leaf spring on the other side of said central support, an armature pivotable about a central axis, said armature having first and second arms projecting in opposite directions from said axis, means at one end of said armature for engaging one end of said spring, means at the other end of the armature for engaging the other end of said spring, said engaging means being alternately movable with the armature, to a first position in which one of the engaging means engages one end of the leaf spring and deflects the spring to move said first blade contact into engagement with said first and third coaxial contacts, and in which the other engaging means is spaced from the other end of the spring to permit the spring to move the second blade contact into engagement with the ground plane, and to a second position in which the other engaging means engages the other end of the leaf spring and deflects the spring to move the second blade contact into engagement with the second and third coaxial contacts, and in which said one of the engaging means is spaced from the other end of the spring to permit the spring to move the first blade contact into engagement with the ground plane, and electromagnetic means for pivoting said armature.

2. A relay according to claim 1 wherein said engaging means at the ends of the armature each comprise a rod, and means on each rod for engaging the leaf spring.

3. A relay according to claim 2 wherein said means on each rod comprises a glass bead.

4. A relay according to claim 1 wherein each of said pushers comprises grooves for retaining the pusher on the leaf spring, and the leaf spring comprises bayonet slots for engagement in the grooves of the respective pushers.

5. A relay according to claim 4 wherein the grooves of each pusher have a narrow central portion, and enlarged side portions to permit flexing of the leaf spring in said grooves.

6. A relay according to claim 1 wherein each of said pushers comprises means for fixing a respective contact blade to the pusher.

7. A relay according to claim 1 wherein said electromagnet means comprises a magnetic circuit including a permanent magnet for normally pivoting the armature to one position, and an electromagnet energizable with direct current of a predetermined polarity to opposed said permanent magnet and pivot the armature to its other position.

8. A relay according to claim 1 comprising an insulated support plate, said plate having a projection comprising said central support, said leaf spring having a central opening, said projection engaging in said central opening to connect the spring at its center to the insulated plate, said ground plane comprises a ground plate, said insulated plate being mounted on said ground plate, and said insulated plate and ground plate each having openings through which said contact pushers extend.

9. A relay according to claim 1 wherein said insulated support plate comprises a single piece of molded plastic, having insulating guide pins extending through the ground plate, said guide pins guiding said rigid contact blades during movement of the rigid contact blades.

10. A relay according to claim 1 wherein said ground plane comprises a metal plate.

* * * * *